United States Patent [19]

Johnson et al.

[11] Patent Number: 4,489,301

[45] Date of Patent: Dec. 18, 1984

[54] HIGH VOLTAGE, HIGH CURRENT FUSE WITH COMBUSTION ASSISTED OPERATION

[75] Inventors: Peter D. Johnson; Willard T. Grubb, both of Schenectady, N.Y.

[73] Assignee: General Electric Company, Schenectady, N.Y.

[21] Appl. No.: 472,556

[22] Filed: Mar. 7, 1983

Related U.S. Application Data

[63] Continuation-in-part of Ser. No. 412,061, Aug. 27, 1982, abandoned, which is a continuation-in-part of Ser. No. 352,299, Feb. 25, 1982, abandoned.

[51] Int. Cl.[3] ..... H01H 37/76

[52] U.S. Cl. ..... 337/401; 337/403

[58] Field of Search ..... 337/30, 160, 243, 401, 337/403, 404, 406

[56] References Cited

U.S. PATENT DOCUMENTS

| | | | |
|---|---|---|---|
| 719,026 | 1/1903 | Morse | 337/243 |
| 3,958,206 | 5/1976 | Klint | 337/406 |
| 4,176,385 | 11/1979 | Dethlefsen | 337/401 X |
| 4,319,212 | 3/1982 | Leach | 337/159 |
| 4,339,742 | 7/1982 | Leach | 337/279 |

*Primary Examiner*—George Harris

*Attorney, Agent, or Firm*—Lawrence D. Cutter; James C. Davis, Jr.; Marvin Snyder

[57] ABSTRACT

A high voltage fuse comprises one or more fusible strips or wires (fusible elements) electrically connected between nonfusible external electrical connection means with at least one portion of the fusible element ("a rapid melting portion") being designed to melt open when the current exceeds a given value for a given period of time. The fuse further comprises exothermic material, disposed on electrically-conductive wire, which is placed adjacent to portions of the fusible element. Electric circuit connection means connect the electrically-conductive wire to electrically opposite sides of the rapid melting portion. The electrical circuit connection means provides for either parallel or series connection of the wire surrounded by the exothermic material. In operation, during the passage of a sufficiently high current, an arc develops in the immediate vicinity of the rapid melting portions and the voltage drop occurring across this arc supplies power to the electrically-conductive wire which ignites the exothermic material so as to either blast or melt away specific remaining portions of the fuse. As a result, a plurality of series connected arcs are formed so that the sum of the voltages across the arcs increases to a level sufficient to bring the current through the fuse to a zero value in a short time.

13 Claims, 5 Drawing Figures

HIGH VOLTAGE, HIGH CURRENT FUSE WITH COMBUSTION ASSISTED OPERATION

BACKGROUND OF THE INVENTION

This application is a continuation-in-part of Ser. No. 412,061, filed Aug. 27, 1982 which is a continuation-in-part of Ser. No. 352,299, filed Feb. 25, 1982, both abandoned.

The present invention relates to electrical fuse devices for rapidly interrupting current flow when the current level reaches a predetermined design value. More particularly, the present invention relates to compositions which are particularly effective in blasting or melting portions of fusible element for the purpose of electrical current interruption.

Power interruption in high voltage, high current circuits is significant in that failure to properly interrupt these high power electrical currents can often result in extensive damage to machinery or various other portions of an electrical energy distribution system. The fuse devices generally considered herein are those employed in circuits exhibiting voltages in excess of 1,000 volts and are available in a current rating range of between 10 and 50,000 amperes. It should be apparent that electrical currents operating at such high energy levels can produce severe damage in numerous circuit components and systems if the current is not rapidly brought to a zero value in a sufficient short period of time following the occurrence of various high current-drawing line conditions. For example, it is desirable to reliably bring such currents to a zero value within 5 to 10 milliseconds of the occurrence of an event such as a short circuit line fault.

The fuses currently designed to interrupt currents of between 10 and 50,000 amperes have voltage ratings of between 1 and 50 kilovolts and generally consist of a silver ribbon or wire wound on a supporting insulating structure. Typically, a fuse ribbon is perforated at regular intervals along its length and upon passage of excessive current, the ribbon melts at the narrow regions adjacent the perforations, thus establishing a multiplicity of series connected arcs. In such devices, current interruption finally occurs when the sum of the individual arc voltages exceeds the applied voltage. In a wire type fuse, excessive current causes the majority of the fusible element to melt and arc formation to occur. However, a problem with this type of fuse is the potential failure to melt back and form an arc at each perforation position along the silver ribbon or along the length of the wire when current levels are such as to cause melting in more than a few cycles of the frequency of the power source. When such a failure occurs, the total arc voltage does not exceed the system voltage and current continues to flow in the system until some other interruption mode occurs. Accordingly, it is highly desirable to be able to reliably and simultaneously open the fuse element at an adequate number of positions along its length so as to produce the desired number of arcs by simultaneously opening the fuse elements at a plurality of positions alongs its length.

In U.S. Pat. No. 3,958,206, issued May 18, 1976 to R. V. Klint, there is apparently described the use of an exothermic material such as PETN (pentaerithritol tetranitrate) or a ribbon of aluminum/palladium to quickly supply released chemical energy for fast circuit interruption. This exothermic material appears to be actuated thermally or by providing a separate trigger circuit. Moreover, the trigger circuit apparently disclosed uses a current sensor to determine when the exothermic reaction should be initiated. In U.S. Pat. No. 4,176,385, issued Nov. 27, 1979 to Dethlefsen, there is also apparently disclosed an explosively actuated current interrupter. Additionally, the present inventors wish to indicate that the specific circuit interrupter configuration which employs exothermic reaction material in discrete locations along a fuse element, the material being simultaneously ignitable by the heat supplying means at all positions when the fuse opens at a predetermined position, forms no part of the present invention, this configuration having been previously disclosed to the instant inventors by J. G. Leach, an employee of the assignee of the instant invention. However, the invention disclosed herein is distinguishable from this and other previously-described fuses in the use of the specific exothermic reaction material employed, and the configuration of the heat supplying means.

SUMMARY OF THE INVENTION

In accordance with a preferred embodiment of the present invention, a fuse for interruption of high voltage, high current circuits comprises a fusible element electrically connected to nonfusible external electrical connections at each end of the element, the element having a plurality of rapid melting portions which typically comprise a high resistance portion having or developing during operation a higher resistance than the rest of the fusible elements. The resistance is controlled by selection of a suitable cross-sectional area as by providing apertures or narrowed portions in the fusible element or, for example, by the use of lower melting point additions to the strip, or control of heat loss from the strip. The fuse of the present invention also comprises exothermic material disposed about electrically-conductive wire and placed adjacent to at least some of the rapid melting portions of the fusible element, together with circuit connection means which electrically connect the wire surrounded by the exothermic material to electrically opposite sides of the overcurrent sensor.

When a current through the fuse exceeds a predetermined value, a specially selected rapid melting portion of the fusible element is melted and an arc develops. Electrically connected across this special portion of the fuse is electrical circuit connection means which employ the voltage developed across the arc to trigger exothermic material disposed adjacent to other rapid melting portions of the fusible element so as to simultaneously sever the element in a plurality of positions and thus to rapidly interrupt the current flowing through the individual arcs.

Accordingly, it is an object of the present invention to provide a fuse for use in high voltage, high current circuits which rapidly and reliably interrupts all current through the fuse.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may be best understood by reference to the following description taken in connection with the accompanying drawings in which:

DETAILED DESCRIPTION OF THE INVENTION

In accordance with the present invention, the burn or melt-back at a chosen number of positions along a fuse strip is assisted by the simultaneous ignition of a pyrotechnic or exothermic material, such as is used in photoflash lamp primers. This material is placed in contact with or in close proximity to a flusible element at a number of positions along its length. In the various embodiments of the invention shown in FIGS. 1–5 herein, it is to be noted that fuse strip 10 is usually wound in spiral fashion on a supporting structure of refractory insulating material but is illustrated schematically herein to assist in understanding the construction and operation of the device. Furthermore, while the embodiments shown in FIGS. 1–4 illustrate apertures of varying sizes, it is equally possible to employ a strip exhibiting portions having relatively different widths, the essence being the presence of portions of the fusible element exhibiting a rapid melting characteristic in comparison with the remaining portion of the fusible element. Such rapid melting portions are typically provided by fusible element portions exhibiting a higher electrical resistance than the rest of the element. Additionally, those skilled in the art of designing such fuses as are contemplated herein also appreciate the fact that they are typically housed in an enclosed vessel and are surrounded by compacted sand or similar material. Such individuals will also appreciate that while fusible strips are illustrated herein, fusible wires and similar structures may also be employed.

Figure 1:
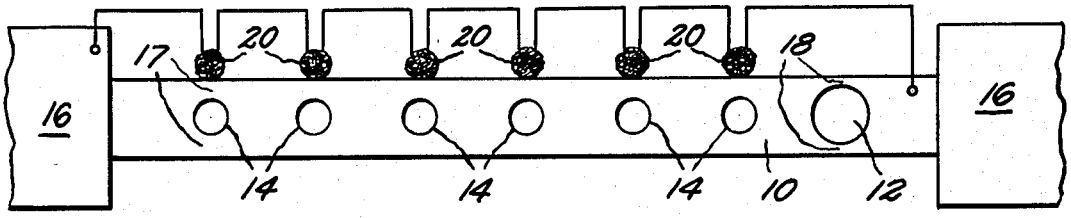
FIG. 1 is a plan view illustrating one embodiment of the present invention.

With respect to FIG. 1, fuse element 10 which typically comprises a metal such as silver or aluminum, is connected to nonfusible external electrical connection means such as bus bar terminals 16, disposed at opposite ends of the fusible strip and preferably comprising copper or a copper alloy. Properly dimensioned copper, tin, cadmium, zinc, lead, magnesium, gold, indium, and other electrically conductive materials are also equally suitable for use in fusible element 10. As used herein, and in the appended claims, the term "fusible" refers to the ability of the material in strip 10 to melt and/or burn upon a passage of a specific current through the strip. Accordingly, it is appreciated that the term fusible is, in general, relative to the current level contemplated and dependent on the material employed and the physical dimensions of the material.

Strip 10 in FIG. 1 includes a plurality of substantially uniform apertures 14 together with a single aperture 12 which has a means to assure that fuse burn-out or melt-back occurs first at portions 18 adjacent to aperture 12. Such means include, but are not restricted to, control of aperture length, width and the thermal conductivity of adjacent filler and the use of lower melting point materials (commonly referred to as m spots). As a result of this burn-out, at a predetermined current level, an electric arc develops across the breaks in strip 10 occurring at position 18. It is the voltage developed across this arc or arcs which operates to energize the combustion-assisting elements of the present invention. During an overload condition, fuse strip 10 separates by melting or burning at position 18. The arc voltage is generally at least 10 volts and may be higher. In FIG. 1, this voltage is applied across the series connection of primer devices 20. This voltage is applied to the connection by means of the leads shown in FIG. 1. These leads are chosen large enough to deliver sufficient current to ignite all the primer simultaneously (that is, within about 1 millisecond of each other). Each primer 20 (here shown as a mass of exothermic material) can be positioned to ignite additional pyrotechnic material (not shown) disposed on strip 10, or adjacent to strip 10, if desired to more reliably melt or burn fuse ribbon 10 at each desired position. In general, it takes approximately 4 milliseconds or less for the primers to burn completely after establishment of the arc at position 18.

Primer 20 typically comprises a 0.8 to 8.0 mil diameter tungsten, tungesten rhenium alloy, nickel chromium alloy or similar wire with an ignition mixture disposed on the wire. The ignition mixture typically comprises a solid oxidant together with a metal, preferably in powdered form, selected from the group consisting of zirconium, hafnium, thorium, aluminum, magnesium, and combinations thereof, or with other combustible metals. The oxidant preferably comprises a material such as potassium perchlorate or other chlorates or perchlorates which react exotheromically with the component being oxidized. The small diameter of the wire ensures that it is heated sufficiently to ignite the mixture disposed on the wire which thereafter burns with almost explosive rapidity. Additionally, an alternative to the use of fine wire to ignite the pyrotechnic material comprises a spark gap adjacent to or buried in the material such as is employed in the Flip Flash$^R$ photoflash lamp. In any event, the exothermic material is placed adjacent to strip 10. The oxidant and metal are held together by any suitable non-reactive binder. The mixture of oxidant and oxidizer may be disposed directly on fusible strip 10 or mounted adjacent to it. Because of the specific materials employed herein, it is generally desirable to provide a moisture-resistant coating over the pellets or bumps of exothermic material. This coating may, for example, comprise sodium silicate. Additionally, for ease of manufacture, it is also possible to fashion the exothermic material into a single continuous strip which is positioned along fusible strip 10.

In the event that strip 10 comprises a low melting point material such as silver, it is the heat generating capability of primer 20 which is more significant rather than its explosive abilities. In such a situation, circuit interruption is accomplished by a melting of the silver strip.

Figure 2:
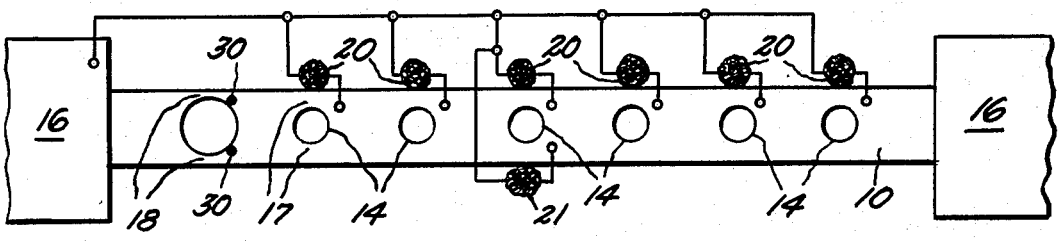
FIG. 2 is a plan view similar to FIG. 1 except that a parallel connection is shown.

FIG. 2 illustrates an embodiment similar to FIG. 1 except that in these latter Figures, primers 20 are electrically connected in parallel across the arc which develops at position 18. In contrast, in FIG. 1, there is a series connection of primers 20. The parallel configuration is somewhat preferred in that it generally results in more reliable triggering of each of primers 20. In the parallel configured case, there is no concern about premature interruption of the current path through the primers. Furthermore, rather than the specific embodiment shown in FIG. 1, it is also possible to form a parallel connection in which is directly connected between the two bus bar terminals 16 so that a break at any point in the fusible element causes all exothermic material to be ignited.

Figure 3:
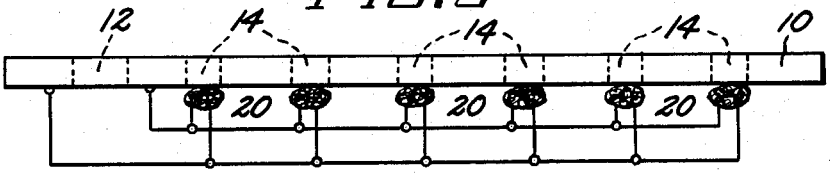
FIG. 3 is a side elevation view of a fusible strip showing the exothermic material disposed beneath a narrowed portion of the fusible strip.

FIG. 3 is a side elevation view of fusible strip 10 which also indicates an alternate position for placement of primer material. In this embodiment, primer material 20 is disposed beneath the narrowed portion of strip 10 adjacent to apertures 14 in strip 10. Again, it is seen that aperture 12 is the largest of the apertures and it is the arc discharge across the severed strip portions in the vicinity of this aperture which provides the electical voltage drop for triggering primers 20 at the other locations so as to rapidly sever the strip in a plurality of places in a simultaneous, or at least near simultaneous, fashion. It should be noted, though, that it is not necessary to dispose primer material adjacent to every opening in the strip.

Figure 4:
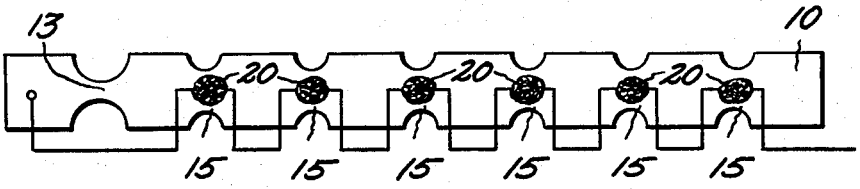
FIG. 4 illustrates an alternate embodiment of the present invention in which the strip possesses narrowed portions of varying widths rather than apertures of varying diameter.

FIG. 4 illustrates the fact that the present invention may also employ selectively narrowed portions of strip 10 instead of employing apertures having varying diameters. In the instant illustration, portion 13 of strip 10 is the special initial rapid melting portion of the strip and it is here that an arc first develops when the current through the strip exceeds a predetermined value, thus severing strip 10. It is the voltage developed across this arc which drives primers 20, here shown connected in series. Each of primers 20 operates to sever a portion 15 of strip 10. However, this severance is almost simultaneous and operates to raise the series voltage and thus to quickly extinguish any current flowing through fuse strip 10 or through arcs linking severed portions thereof.

Figure 5:
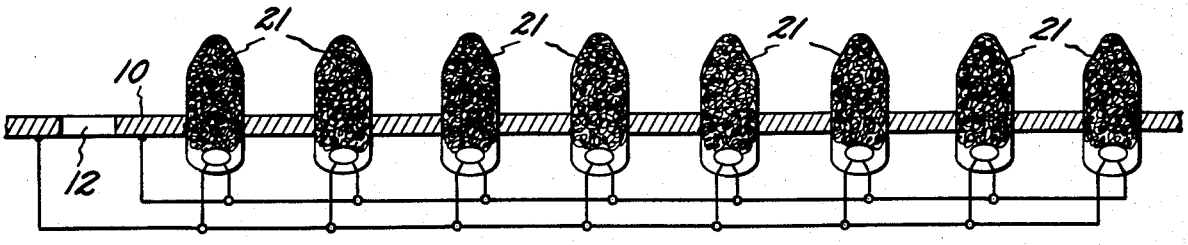
FIG. 5 is a side elevation view illustrating the use of photoflash lamp-like devices to melt back portions of a fusible strip.

FIG. 5 illustrates an embodiment of the present invention in which primer material is enclosed in a structure similar to that provided for conventional flash bulbs. This embodiment is particularly applicable in the event that fusible strip 10 comprises a low melting point such as silver or indium. In this case, severability of the links along the strip depends more upon the temperature developed by the primer material than by its being ruptured in an exothermic blasting reaction.

While it may be preferable for certain embodiments of the present invention to dispose primers 20 immediately adjacent to the rapid melting portions, it is not essential to do so. In particular, in certain embodiments of the present invention the fusible element may be disposed in a helical pattern around a ceramic, cylindrical substrate. In such cases it is not always practical, from a manufacturing point of view, to insure that the notched portions are aligned with primer material disposed on the ceramic cylinder. Furthermore, it has been found that it is not in fact necessary to so dispose the fusible element. While primers 20 have generally been described as being disposed on an electrically conductive wire through which sufficient current passes to heat and to ignite the primer material, it should also nonetheless be appreciated that any electrically energizable heat-generating means may be employed to serve this same function. However, in the event that a resistively heated wire is employed to trigger primers 20, it is nonetheless desired that this wire or wires exhibit certain characteristics which help to ensure reliable fuse operation. In particular, it is desired that the electrically conductive wires on which primers 20 are disposed exhibit a relatively small cross section in the vicinity of the masses of primer material and that they exhibit an otherwise relatively large cross-sectional area. This configuration is helpful in ensuring that heating effects are concentrated at the primer masses. Additionally, the larger diameter portions of the connecting wires assures that sufficient current is permitted to flow through the trigger circuit when the main fusible element is disrupted. This also reduces the chance that the trigger circuit might malfunction as a result of premature melting of a portion of the wire circuit midway between primer masses.

From the above it may be appreciated that the present invention provides a fuse for interrupting high voltage, high current electrical circuits in a unique and effective manner. In particular, the fuse of the present invention is highly reliable and operates rapidly to establish a plurality of series connected arcs so that the sum of the voltages across the arcs increases to a level sufficient to rapidly bring the current through the fuse to a zero value.

While the invention has been described in detail herein in accord with certain preferred embodiments thereof, many modifications and changes therein may be effected by the appended claims to cover all such modifications and changes as fall within the true spirit and scope of the invention.

The invention claimed is:

1. A high voltage fuse with combustion-assisted operation, comprising:

a fusible element electrically connectable to nonfusible external electrical connections at each end of said fusible element, said element containing at least one rapid melting portion at which melting is initiated upon passage of an electrical current through said element having a magnitude insufficient to melt the remaining portion of said fusible elements;

at least one mass of exothermic material disposed on an electrically-conductive wire, said exothermic material being disposed at selected points along the length of said fusible element, said exothermic material comprising oxidizer selected from the group consisting of chlorates and perchlorates, together with oxidizable material, said oxidizable material being selected from the group consisting of zirconium, hafnium, thorium, aluminum, magnesium, and combinations thereof; and electric circuit connection means connecting said electrically-conductive wires to electrically opposite sides of said rapid melting portion of said fusible element.

2. The fuse of claim 1 in which said electrically-conductive wires holding said exothermic material are electrically connected in parallel.

3. The fuse of claim 1 in which said electrically-conductive wires holding said exothermic material are electrically connected in series.

4. The fuse of claim 1 in which said fusible elements comprise material selected from the group consisting of silver, aluminum, copper, zinc, tin, cadium, lead, magnesium, gold and indium.

5. The fuse of claim 1 in which said electrically-conductive wire comprises material selected from the group consisting of tungsten, tungsten rhenium alloys, and alloys comprising nickel and chromium.

6. The fuse of claim 1 in which said exothermic material is disposed within an enclosure.

7. The fuse of claim 6 in which said fusible element comprises silver.

8. The fuse of claim 1 including a plurality of said fusible elements connected in parallel.

9. The fuse of claim 1 in which said fuse further includes a refractory support member upon which said fusible elements are disposed.

10. The fuse of claim 9 further including a housing surrounding said support member, said exothermic material, said fusible elements and said electric circuit connection means and further containing sand disposed about said support members.

11. The fuse of claim 1 in which said electrically conductive wire, on which said at least one mass of exothermic material is disposed, exhibits at least one portion along its legth having a relatively small cross-sectional diameter in the vicinity of said at least one exothermic mass.

12. A high voltage fuse with combustion assisted operation, comprising:

a fusible element electrically connectable to nonfusible external electrical connection means at each end of said fusible element, said element containing at least one rapid melting portion at which melting is initiated upon passing of an electrical current through said element having a magnitude insufficient to melt the remaining portion of said fusible element;

at least one mass of exothermic material and electrically-energizable heat-generating means disposed closely adjacent said at least one mass, said exothermic material being disposed adjacent to said rapid melting portions at selected points along the length of said fusible element, said exothermic material comprising oxidizer selected from the group consisting of chlorates and perchlorates, together with oxidizable material, said oxidizable material being selected from the group consisting of zirconium hafnium, thorium, aluminum, magnesium, and combinations thereof; and electric circuit connection means connecting said heat-generating means to electrically opposite sides of said rapid melting portion of said fusible element.

13. The fuse of claim 12 in which said electrically conductive wire, on which said at least one mass of exothermic material is disposed, exhibits one portion along its length having a relatively small cross-sectional diameter in the vincinity of said at least one exothermic mass.

* * * * *